United States Patent [19]

Pringle

[11] 4,368,911

[45] Jan. 18, 1983

[54] SUBSURFACE CONDUIT SETTING AND PULLING TOOL

[75] Inventor: Ronald E. Pringle, Houston, Tex.

[73] Assignee: Camco, Incorporated, Houston, Tex.

[21] Appl. No.: 183,117

[22] Filed: Sep. 2, 1980

[51] Int. Cl.[3] ..... E21B 23/00

[52] U.S. Cl. ..... 294/86.15; 166/98; 294/86.25

[58] Field of Search ..... 294/86.1, 86.14, 86.15, 294/86.17–86.19, 86.26, 86.3–86.34, 94, 96; 166/98, 99, 123, 181, 212, 216, 217; 285/144, 145

[56] References Cited

U.S. PATENT DOCUMENTS

| | | | |
|---|---|---|---|
| 2,734,581 | 2/1956 | Bonner | 166/98 |
| 2,965,175 | 12/1960 | Ransom | 166/212 X |
| 2,984,302 | 5/1961 | Church | 294/86.15 X |
| 3,147,809 | 9/1964 | Thomas | 166/98 |

*Primary Examiner*—Johnny D. Cherry
*Attorney, Agent, or Firm*—Fulbright & Jaworski

[57] ABSTRACT

A tool for setting or pulling a subsurface tool from a conduit having a pressure charge gas piston and cylinder which are releasably locked together. The piston and cylinder is actuated by setting slips on the tool and unlocking the piston and cylinder. First and second shoulders are actuated by the piston and cylinder to set or pull the well tool. The piston and cylinder includes a movable member initially limiting the communication of the gas with the piston. Drag blocks are connected to the slips for preventing expansion of the slips on downward movement of the tool, and a connection between the tool body and one of the piston and cylinder will set the slips on upward movement of the body and release the piston and cylinder. The tool is particularly useful in setting and pulling a safety valve from a flowline.

6 Claims, 14 Drawing Figures

FIG.1
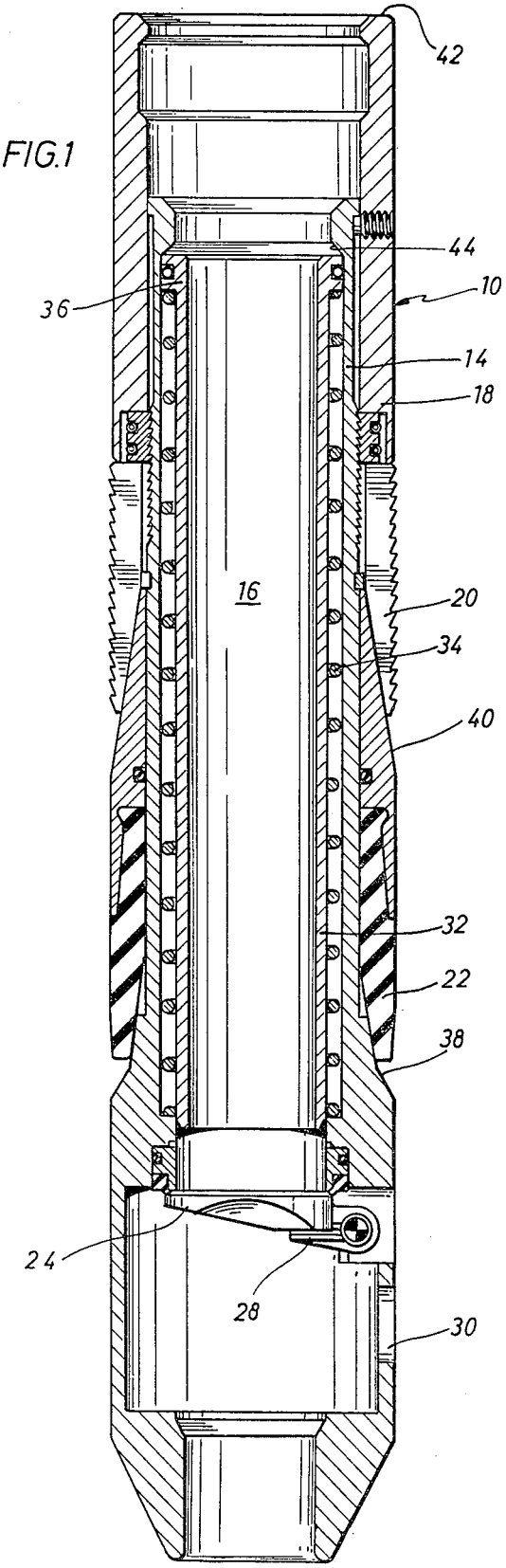
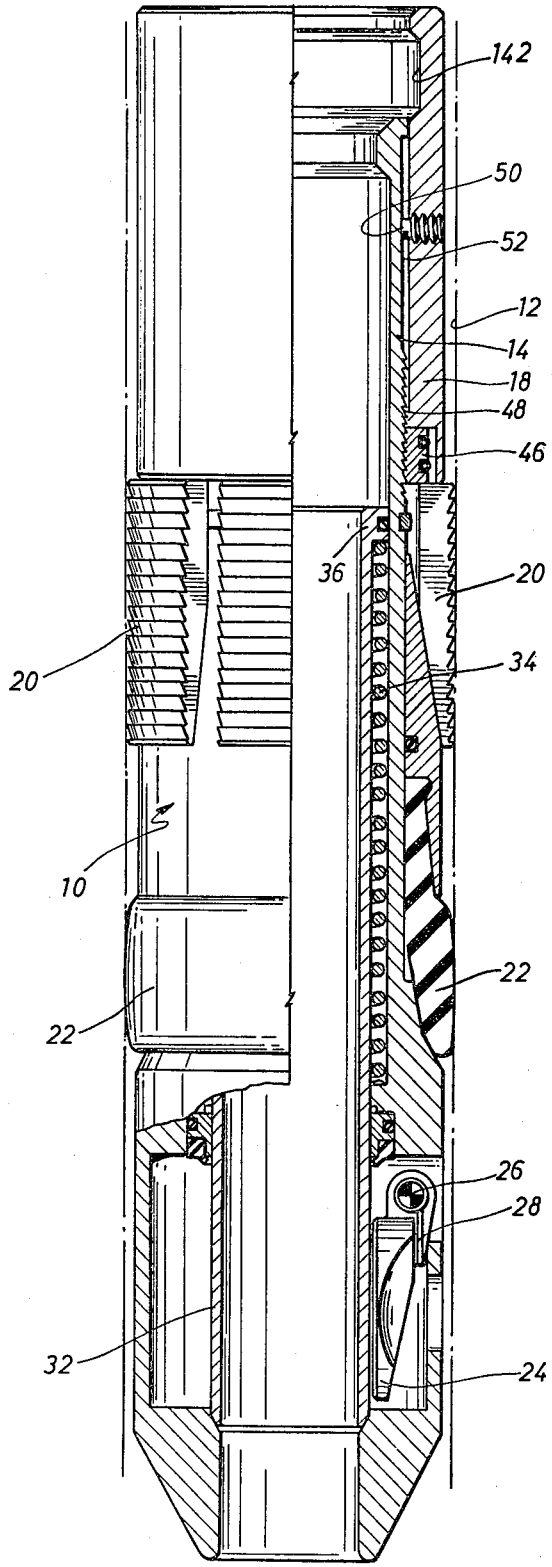
FIG.2

SUBSURFACE CONDUIT SETTING AND PULLING TOOL

CROSS-REFERENCES TO RELATED APPLICATIONS

This application is related to concurrently filed application entitled Controlling the Flow of Fluid Through a Flowline, Ser. No. 183,116.

BACKGROUND OF THE INVENTION

It is old to provide various types of subsurface safety valves in the production tubing of an oil and/or gas well to shut off fluid flow under emergency conditions. The flowlines leading from the well site which transport the produced well fluids to other locations do not usually include safety valves. However, in the event of damage to the well rig, the flowlines as well as the production lines may be broken. In this event, the accumulated production fluids in the flowline may escape contributing to pollution as well as to any fire or explosion which may occur. Furthermore, conventional safety valves which are used in production tubing are not suitable for setting and retrieving from flowlines which are generally smooth walled pipelines which unlike production tubing do not include landing nipples.

The present invention is directed to an apparatus for setting or pulling a subsurface tool from a conduit, and is particularly adapted to set and pull a safety valve from a flowline.

SUMMARY

The present invention is generally directed to a tool for setting or pulling subsurface tools from a conduit and particularly for setting or pulling a safety valve from a flowline.

Another feature of the present invention is the provision of a tool for setting in or pulling from a conduit a subsurface tool having a pair of actuating shoulders. The tool includes a tubular body with slip means telescopically positioned on the exterior of the body for engaging the interior of the conduit and drag lock means connected to the slip means for preventing expansion of the slips on downward movement of the tool through the conduit. The tool includes first and second shoulder members for engaging the actuating shoulders of the downhole tool and a coacting piston and cylinder means one of which is connected to the first shoulder member and the second of which is connected to the second shoulder member in which the cylinder is charged under pressure with a gas. The piston and cylinder means are initially releasably locked together and means are provided for actuating the piston and cylinder means by movement of the body whereby the piston and cylinder means will move the first and second shoulder members for actuating the downhole tool.

Still a further object is the provision in which the cylinder includes movable means initially limiting the communication of the pressured gas with the piston.

Yet a further object is the provision of a wedge member positioned for expanding the slip means and is connected to one of the pistons and cylinder and releasably connected to the other of the piston and cylinder for initially locking the piston and cylinder together. A connection is provided between the body and one of the piston and cylinder whereby upward movement of the body will set the slip means for releasing the piston and cylinder from each other thereby allowing the piston and cylinder to actuate the first and second shoulder members relative to each other.

Other and further objects, features and advantages will be apparent from the following description of a presently preferred embodiment of the invention, given for the purpose of disclosure, and taken in conjunction with the accompanying drawings.

BRIEF DESCRIPTION OF THE DRAWINGS

FIG. 1 is an elevational view, in cross section, of the safety valve of the present invention shown in the closed position being run into a flowline, FIG. 2 is an elevational view, in quarter cross-sectional view, showing the safety valve of FIG. 1 in the open position set in a flowline.

DESCRIPTION OF THE PREFERRED EMBODIMENT

Figure 3:
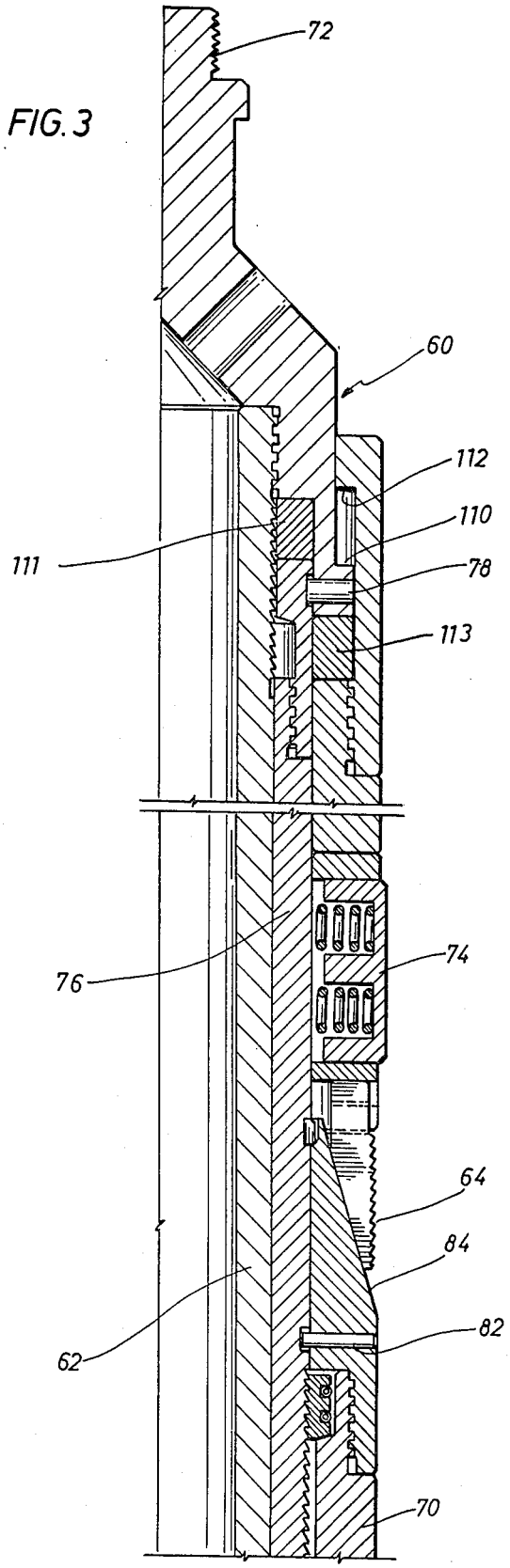
FIGS. 3, 4 and 5 are continuations of each other and are half-elevational views, in cross section, of a setting tool, shown in the running position, for setting the safety valve of FIGS. 1 and 2.

While the present setting and pulling tool may be used for setting and pulling various types of subsurface tools, it will be described for purposes of illustration of setting and pulling a safety valve.

Referring now to the drawings, and particularly to FIGS. 1 and 2, the reference numeral 10 generally indicates the safety valve of the present invention which is adapted to be installed in a flowline 12 which leads from a production oil and/or gas rig for transmitting the produced fluids, such as oil and gas, to a desired location. The flowline 12, generally includes a conduit having a smooth inner bore such as a plurality of conduit joints which are welded together.

The valve 10 includes a body 14 having a bore 16 therethrough. A slip holder 18 which carries a plurality of slips 20 is provided which telescopically engages the exterior of the body 14. The slips 20 are in the retracted position, as best seen in FIG. 1, when the safety valve 10 is being run into the flowline 12 but which are expanded outwardly, as best seen in FIG. 2, for engaging the interior of the flowline 12 for supporting the valve 10 from the flowline 12. Expandable seal means 22 are provided telescopically positioned on the body 15. The seal means 22 are in the retracted position, as best seen in FIG. 1, when the valve 10 is being run in the flowline 12 and are thereafter expanded outwardly for sealing between the body 14 and the interior of the flowline 12, as best seen in FIG. 2.

The safety valve 10 includes a valve closure member 24, here shown as a flapper-type valve, although any suitable type of valve closure member, such as a ball valve, may be utilized to be movable between an open position for allowing flow downwardly through the bore 16, as best seen in FIG. 2, or movable to a closed position, as best seen in FIG. 1, for preventing reverse flow through the flowline 12. The flapper valve 24 pivots around a pin 26 and is urged to a closed position both by a spring 28 and by fluid flow entering an opening 30 on the backside of the flapper valve 24. The opening and closing of the flapper valve 24 is controlled by a tubular member 32 which is telescopically positioned in the body 14 and is yieldably urged by means such as a spring 34 in an upward direction for allowing the flapper valve 22 to move to a closed position. The tubular member 32 includes a choke or piston 36 which is exposed to the fluid flow directed downwardly through the valve 10 which acts to move the tubular member 32 downwardly to open the valve element 24 as best seen in FIG. 2.

In order to set the slips 20 and seal 22, suitable means are provided such as a first wedge member 38 on the body 14 and a second wedge member 40 telescopically engaging the exterior of the body. The slips 20 and the seal 22 are set by a relative downward movement of the slip holder 18 relative to the body 14. For providing such movement, an engaging shoulder 42 is provided on the slip holder member 18 and an engaging shoulder 44 is provided on the body 14. Movement of the engaging shoulders 42 and 44 toward each other will move the safety valve 10 from the position shown in FIG. 1 to a set position as best seen in FIG. 2.

Movement of the actuating shoulders 42 and 44 will, as best seen in FIG. 2, move the slip holder member 18 downward relative to the body 14 causing the slips 20 to engage the interior of the flowline 12 and cause the seal 22 to be set in a sealing relationship with the interior of the flowline 12 by the action of the wedge members 38 and 40. This secures and supports the valve 10 from the flowline 12. A one-way clutch is provided between the slip holder member 18 and the body 14 such as ratchet segments 46 coacting with ratchet teeth 48 on the body 14 for holding the slip means 20 and seal 22 in an expanded position. A pin 50 is provided in one of the members 18 and 14 such as in the slip holder member and engages a slot 52 in the other member such as the body 14 for preventing disengagement between the members 18 and 14.

After the valve 10 is set in the flowline 12 it automatically functions as a safety valve in allowing normal flow of fluids through the flowline 12 and bore 16 of the valve 10 from an upstream to a downstream direction, but prevents reverse flow through the valve 10 which would occur in the event that the flowline 12 was damaged or ruptured upstream of the valve 10. That is, normal flow through the flowline 12 will act against the choke or piston 36 on the tubular member 32 to move it in a downward direction to maintain the valve closure member 24 in the open position as best seen in FIG. 2. In the event that fluid flow upstream is interrupted for any reason, a force of the flowing fluid on the piston 36 will cease and the spring 34 will move the tubular member 32 in an upward direction allowing the valve closure member 24 to close preventing flow in the reverse direction through the valve 10.

Figure 4:
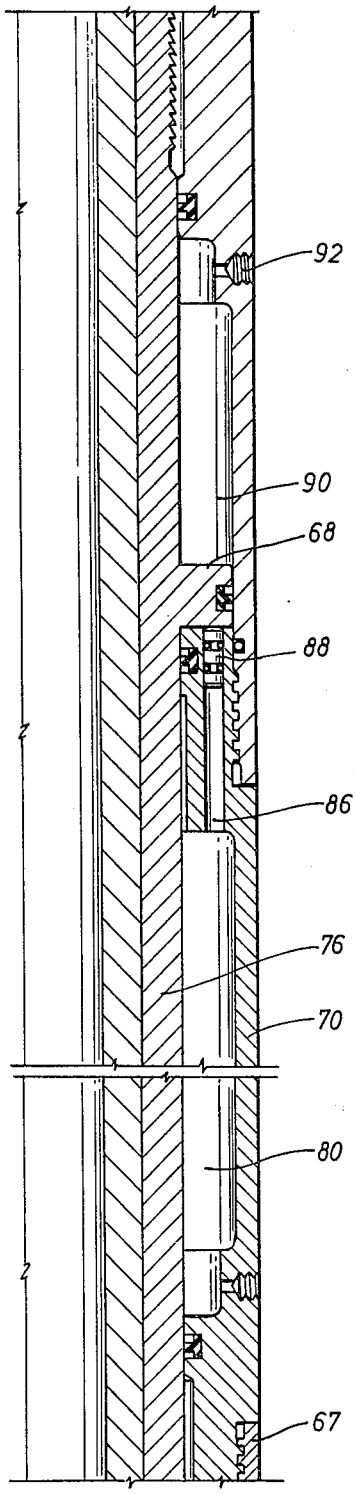
Figure 5:
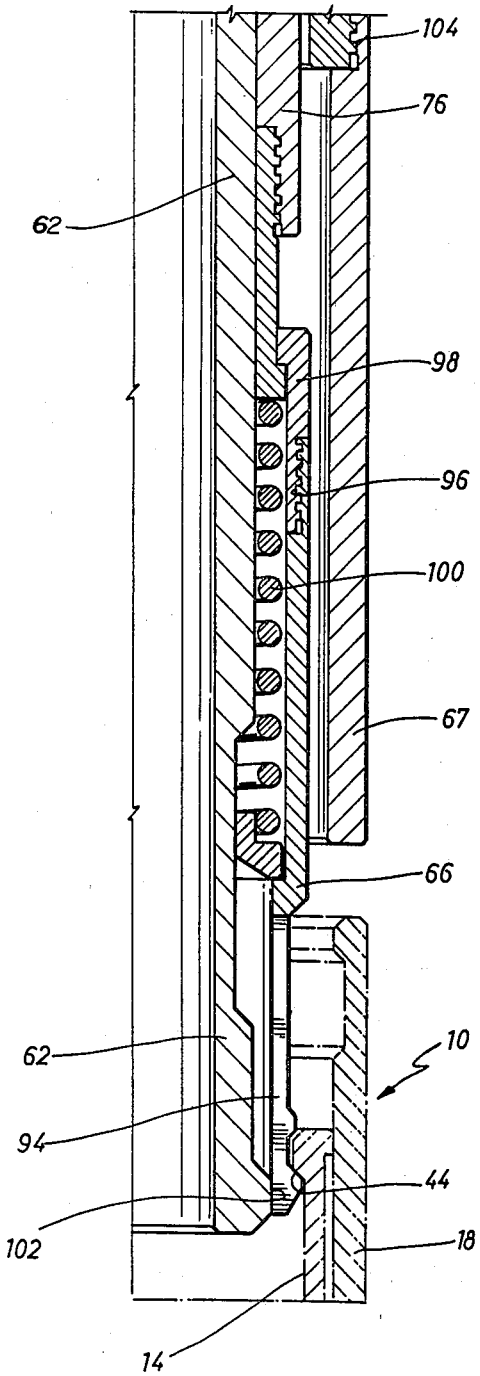
Figure 8:
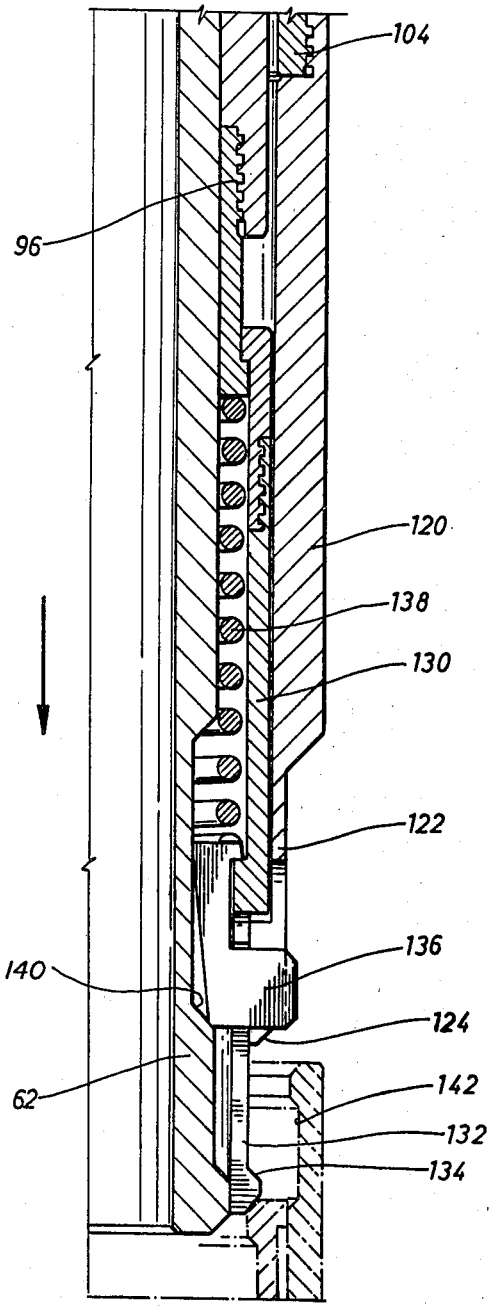
FIG. 8 is a half-elevational view, in cross section, of the lower end of the tool with a pulling adapter connected thereto and in position to engage a safety valve.

Referring now to FIGS. 3–5, the tool of the present invention for setting the safety valve 10 in a conduit 12 is best seen. The tool, generally indicated by the reference numeral 60 includes a tubular body 62, slip means 64 (FIG. 3), a first shoulder means 66 and a second shoulder means 67 (FIG. 5) for setting the safety valve 10, and a coacting piston means 68 and cylinder means 70 (FIG. 4). The body 62 includes a suitable connection such as threads 72 for connecting the body to means for moving the tool 60 through a flowline such as on a wireline (not shown).

The slip means 64 is telescopically positioned on the exterior of the body 62 for movement thereon and for engaging the interior of the conduit 12. Drag block means 74 are connected to the slip means 64 and are spring-loaded outwardly to engage the interior of the conduit 12 for preventing the expansion of the slips 64 on downward movement of the tool 60 through the conduit 12. The shoulder means 66 includes a tubular member 76 connected to one of the piston and cylinder, here shown as being connected to the piston 68, and in addition is connected to the body 62 through a shear pin 78. The shoulder means 67 is also connected to the other of the piston and cylinder, here shown as being connected to the cylinder 70. The cylinder 70 includes a chamber 80 which includes a pressure charge, such as nitrogen, for urging relative movement between the piston 68 and the cylinder 70. However, the piston 68 and cylinder 70 are initially releasably connected to each other for preventing actuation until the tool 60 is placed in its proper position in the conduit 12. For initially locking the piston 68 and cylinder 70 together, a shear pin 82 (FIG. 3) is connected between the cylinder 70 and member 76. A wedge member 84 connected to the cylinder 70 is thus also held in a fixed position adjacent the slips 64 as the tool 60 is moved downhole.

For additionally limiting the force of the pressure charge in chamber 80 from initially acting on the piston 68, the cylinder 70 may include a passageway 86 and a movable seal spool 88 therein which initially limits the communication of the pressure charge in chamber 80 acting on the piston 68. The cylinder 70 includes a second chamber 90 on the second side of the piston 68 which may be atmospheric pressure or by removing the sealing plug 92 may be merely exposed to pressure in the flowline 12, either of which will be at a considerably lower pressure than the pressure charge in cylinder chamber 80.

Referring now to FIG. 5, is is noted that the safety valve 10 is supported from the tool 60 in its unset position (FIG. 1) and is set by the setting adapters which may be quickly and easily connected to the tool 60 or removed for being replaced by a pulling adapter, as will be more fully described hereinafter. Thus, the first shoulder means 66 includes a plurality of collet members 94 which are connected by threads 96 to member 98 which is telescopically mounted on and supported from member 76 and yieldably urged by spring 100 to a downward position. The safety valve 10 may be quickly and easily connected to and supported from the tool 60 by moving the collet fingers 94 downwardly to engage the top of the body 14 of the safety valve 10 whereby they will move upwardly against the spring 100 and be deflected against the exterior of the body 62 at a position above the support 102. After the collet fingers 94 engage the actuating shoulder 44 on the safety valve 10 the collet fingers 94 move outwardly and the body 62 is allowed to move upwardly to bring the supporting shoulder 102 behind the backside of the fingers 94 thereby securely locking the safety valve 10 on to the lower end of the well tool 60. The second shoulder means 67 is secured to the cylinder 70 by threads 104.

Figure 9:
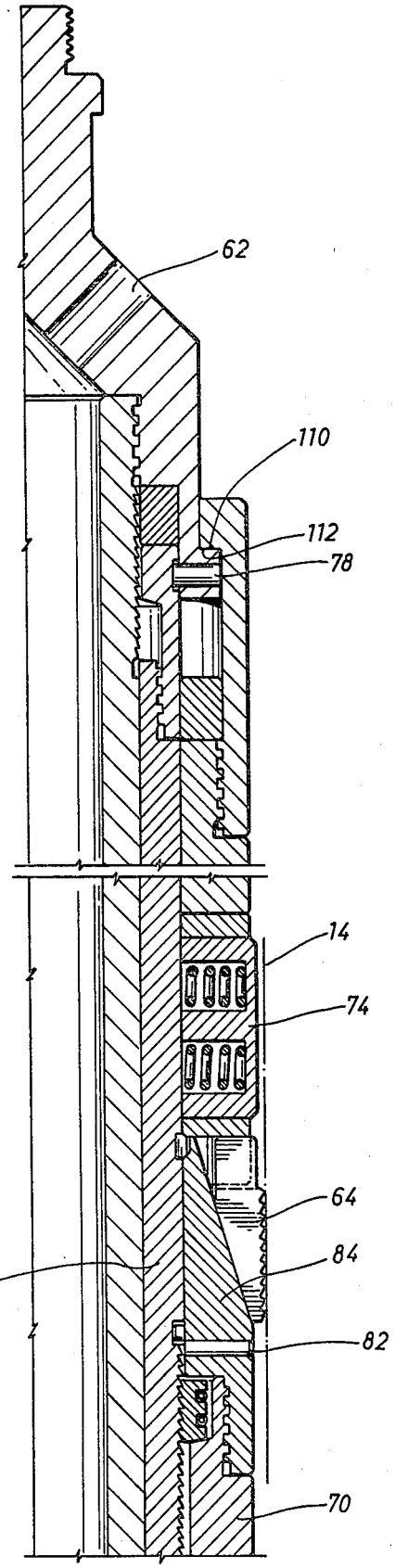
FIG. 9 is a view similar to FIG. 3 but shown in the actuating position.

Referring now to FIGS. 7, 8, 9 and 11, the setting of the safety valve 10 by the tool 60 is best seen. Referring first to FIG. 9, after the tool 60 moves downwardly through the flowline 12 to the desired position to set the safety valve 10, the body 62 is moved upwardly whereby the drag block means 74 which engage the interior of the flowline 12 caused the slip means 64 to telescope downwardly relative to the body 62, and move the slip 64 up the wedge member 84 causing the slips to engage the interior of the flowline 12. Setting of the slips 64 stops further upward movement of the cylinder 70, but member 76 which is connected to the piston 68 continues to move upwardly as it is connected to the body 62 through the shear pin 78. The shear pin 78 which is set at a higher break point than shear pin 82 causes the shear pin 82 to shear allowing the piston 68 to move in the cylinder 70.

Figure 7:
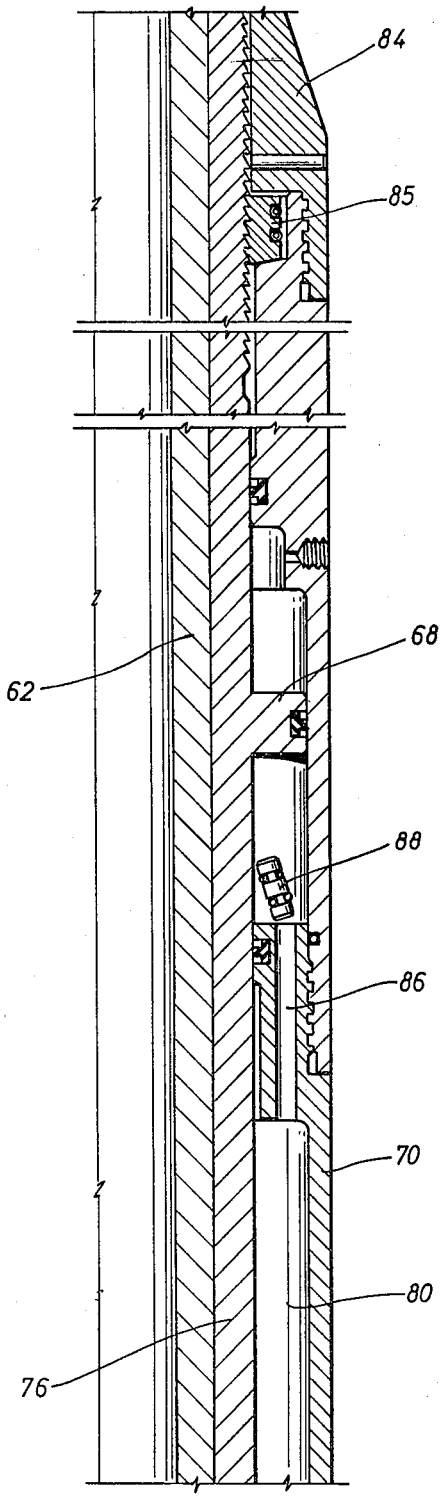
FIG. 7 is a half-elevational view, in cross section, of the tool portion of FIG. 4 in an actuated position.
Figure 11:
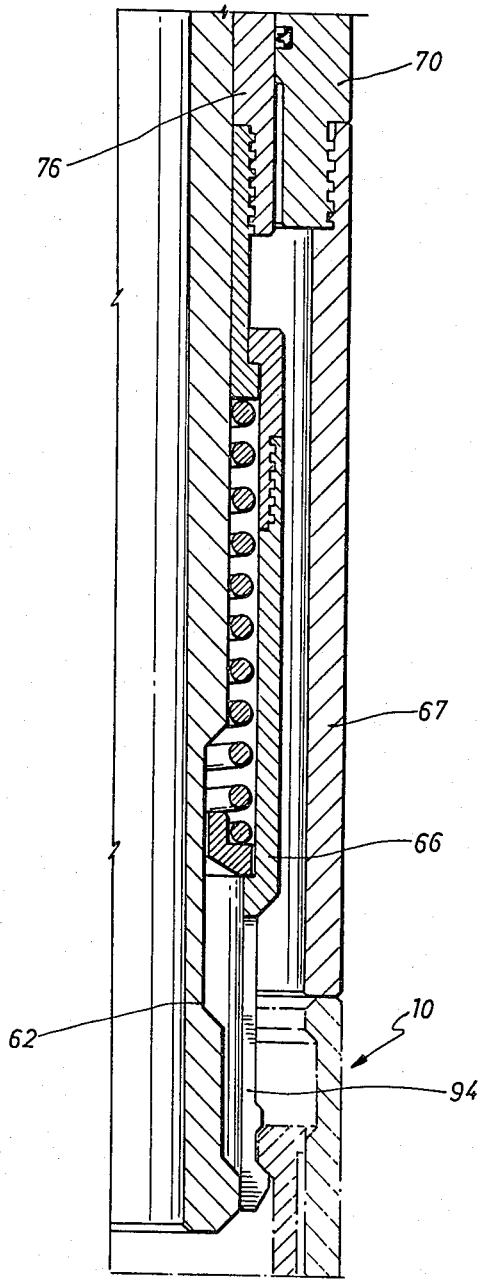
FIG. 11 is a view similar to FIG. 5 but shown in the valve setting position.

Referring now to FIG. 7, as the piston 68 moves upwardly in the cylinder 70, the spool 88 moves out of passageway 86 thereby allowing the full force of the charged gas in chamber 80 to be directed against the entire surface of the piston 68. Thereafter, the gas charge creates further relative movement between the piston 68 and the cylinder 70, and as best seen in FIG. 11 causes a relative movement between the first shoulder means 66 and the second shoulder means 67 for setting the safety valve 10 as has been previously described. Clutch 85 holds the piston 68 and cylinder 70 in the set position.

Figure 12:
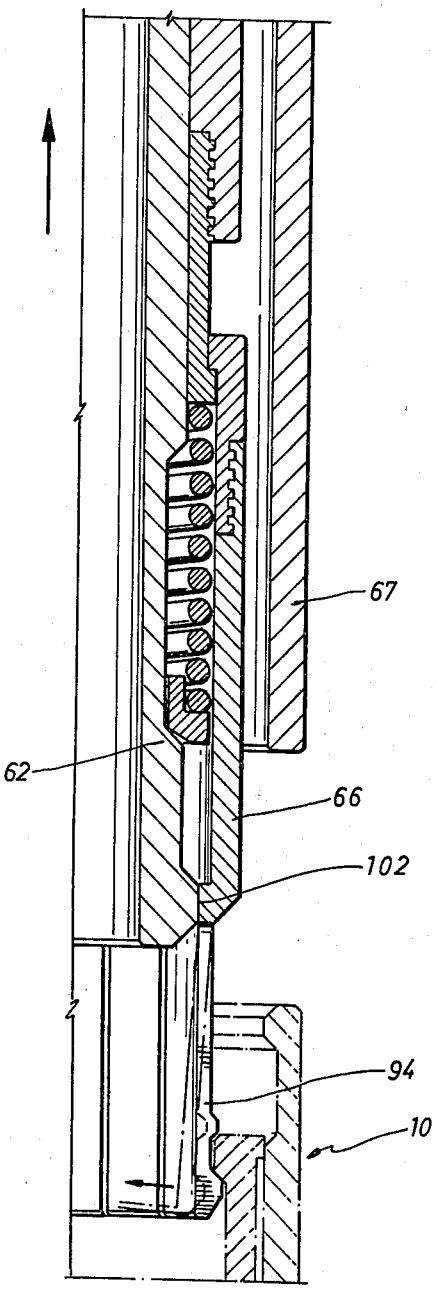
FIG. 12 is a view similar to FIG. 11, but shown in the releasing position.

After the safety valve 10 is set, a further upward movement of the body 62 will release the tool 60 from the set safety valve. That is, coacting shoulders 110 and 112 (FIG. 9) are provided between the body 62 and the slip means 64 for releasing the slip means 64 if they have not already been previously released by downward movement of the cylinder 70 and upward movement of the body 62, will shear pin 78 thereby allowing the tubular body 62, as best seen in FIG. 12, to move upwardly relative to the shoulder means 66 carrying the shoulder 102 upwardly thereby allowing the collet fingers 94 to spring inwardly and be released from the actuating shoulder 44 on the safety valve 10.

The tool 60 may also be used to release and pull the safety valve 10 by replacing the setting adapter members 94 and 67 with pulling adapters, removing spacers 111 and 113 (FIG. 3) and adding clutch 115.

Figure 6:
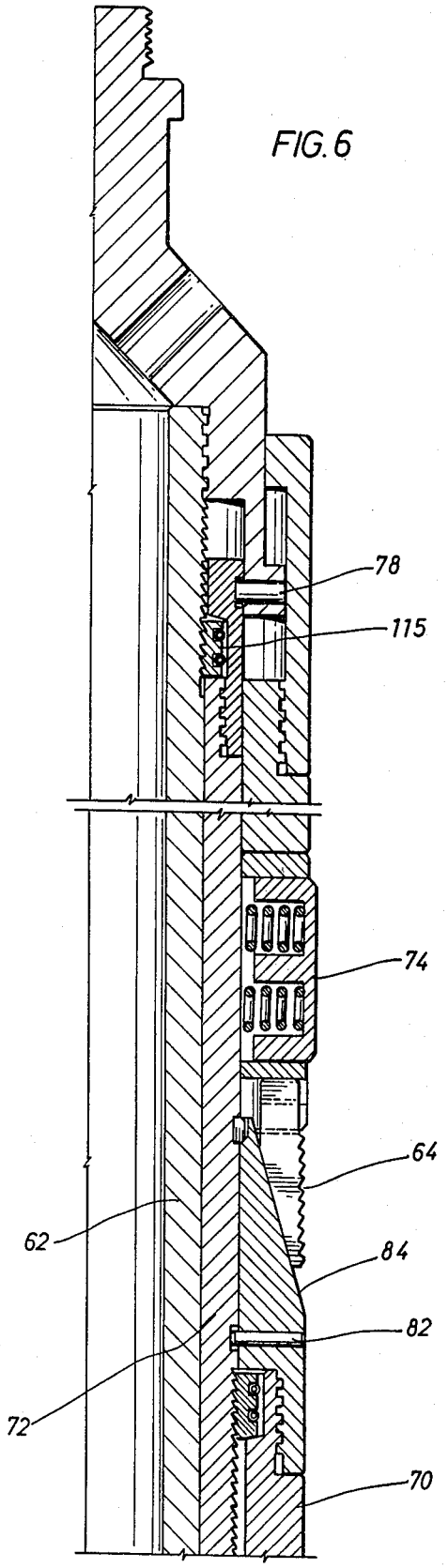
FIG. 6 is a half-elevational view, in cross section, of the top of the tool of FIG. 3 modified to be used as a pulling tool for the safety valve of FIGS. 1 and 2.

Thus referring to FIG. 6, with spacers 111 and 113 removed and clutch 115 added, the top portion of the tool 60 is in position to be run into the flowline and retrieve a safety valve. And referring to FIG. 8, the second shoulder setting adapter 67 (FIG. 5) is replaced with a second shoulder pulling adapter 120 which includes a plurality of split fingers 122 having a contoured lower surface 124 which mates with the top of the body 14 of the safety valve 10. In place of the setting collet member 94 (FIG. 5), a pulling adapter 130 (FIG. 8) is connected to the threads 96 and includes a plurality of collet members 132 having a shoulder 134 for coacting with and supporting the body 14 of the safety valve 10 after the safety valve is released. Member 130 also includes a plurality of dogs 136 which are urged downwardly by a spring 138 and against a beveled shoulder 140 on the body 62 to cause the dogs 136 to move into a retrieving groove 142 on the safety valve 10.

Figure 13:
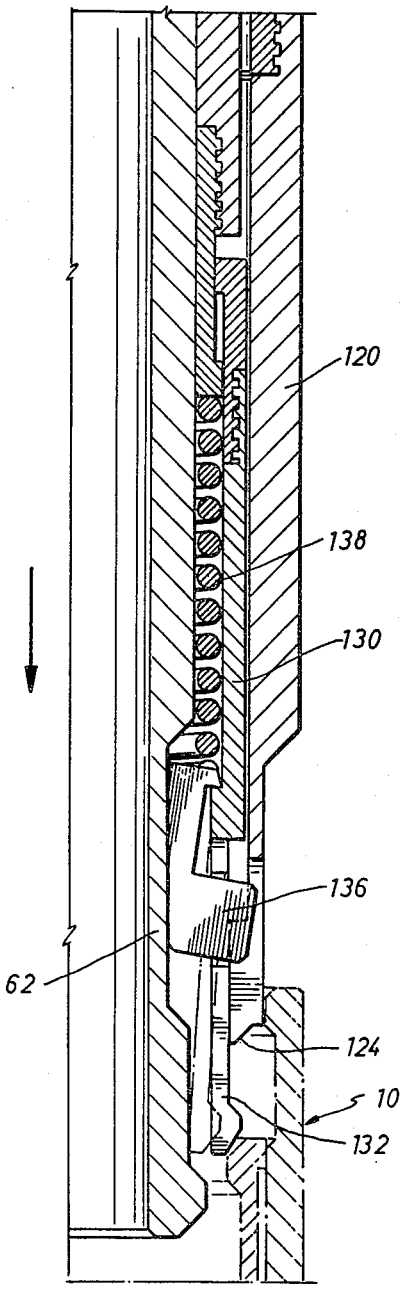
FIG. 13 is a view similar to FIG. 8, but shown in a further engaging position.
Figure 14:
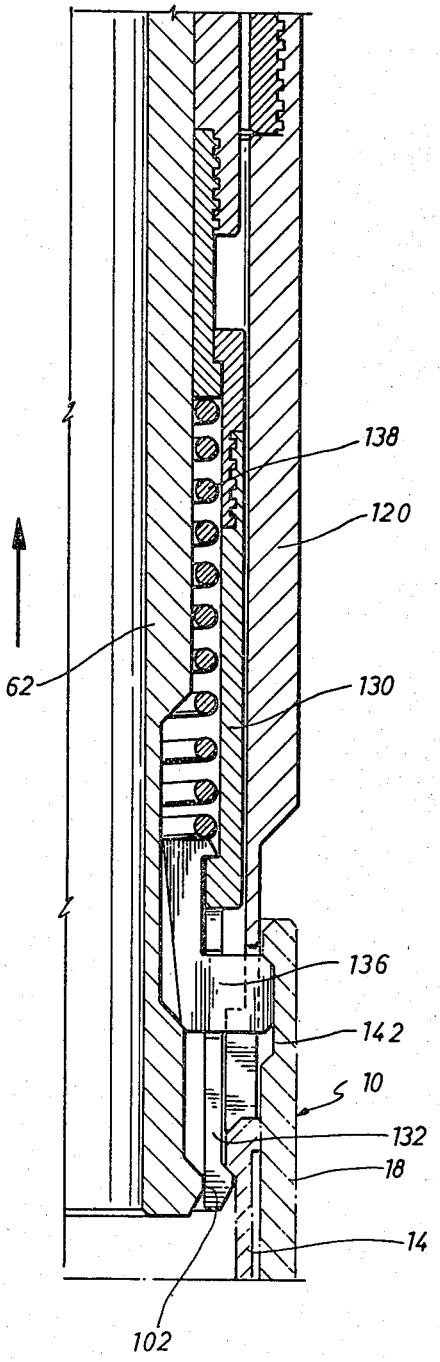
FIG. 14 is a view similar to FIG. 13 with the safety valve released and being pulled.

In order to engage the pulling adapter with the set safety valve 10, the tool 60 is lowered downhole, and as best seen in FIG. 13, the bottom of the collet fingers 132 engages the top of the body 14 of the safety valve 10 whereby the collet fingers 132 depress the spring 138 and move inwardly against the body 62 until they can pass the top of the body 14 and the dogs 136 are retracted against the body 62 so the pulling adapter may engage the safety valve 10. Further downward movement of the pulling tool as best seen in FIG. 14 allows the collet fingers 132 to spring back into place into position against the shoulder 102 to be locked into position to grab the body 14 when the valve 10 is released. Similarly, the dogs 136 are moved into alignment with the pulling notch 142 by the spring 138 and bevel 140 to engage the notch 142.

Figure 10:
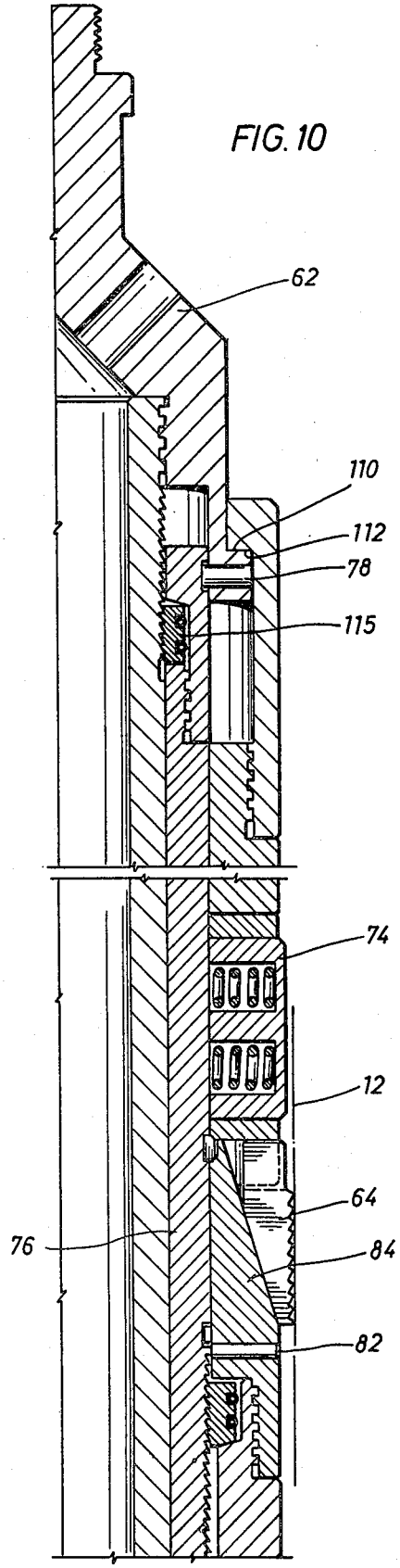
FIG. 10 is a view similar to FIG. 6 but shown in the actuating position.

Thereafter, the tool 60 is actuated in the same manner as described above in connection with setting the safety valve 10. Referring to FIG. 10, the tool is raised causing the drag blocks 74 to set the slips 64, shear pin 82 whereby the piston 68 and cylinder 70 are actuated (FIG. 7) to cause downward movement of the second shoulder pulling adapter 120 and upward movement of the first shoulder pulling adapter 130. The unseating of the safety valve 10 is best seen in FIG. 14 in which the piston and cylinder of tool 60 has been actuated causing relative movement between the pulling adapters 120 and 130 to move the slip holder 18 upwardly relative to the body 14 (FIG. 2) of the safety valve 10. Referring to FIG. 2, the upward movement shears the clutch teeth 48 to release and retract slips 20 whereby the safety valve 10 is released from the conduit 12.

With the setting tool in engagement as shown in FIG. 14 the safety valve 10 may be removed by an upward movement of the tool 60.

As a safety measure in the event the safety valve 10 is stuck and cannot be pulled, the pulling tool 60, as shown in FIG. 6, may be jarred downwardly to shear pin 78 and move body 62 downwardly to release the dogs 136 and collets 132. Thereafter the tool 60 may be removed as upward movement of body 62 will carry member 72 through the clutch 115.

The present invention, therefore, is well adapted to carry out the objects and attain the ends and advantages mentioned as well as others inherent therein. While a presently preferred embodiment of the invention and method of operation have been given for the purpose of disclosure, numerous changes in the details of construction and arrangement of steps of the process will be readily apparent to those skilled in the art which are encompassed within the spirit of the invention and the scope of the appended claims.

What is claimed is:

1. A tool for setting in or pulling from a conduit a subsurface tool having a pair of actuating shoulders which are moved relative to each other comprising, a tubular body, slip means telescopically positioned on the exterior of the body for engaging the interior of the conduit, means on said slip means and body for expanding said slip means on upwardly movement of the body, first and second shoulder members for engaging said actuating shoulders, coacting piston and cylinder means mounted on said body and releasably locked together, one of said piston and cylinder means is connected to the first shoulder member and the second of said piston and cylinder means is connected to the second shoulder member, means for actuating said piston and cylinder means by movement of said body for moving said actuating shoulders relative to each other.

2. The apparatus of claim 1 wherein said cylinder means is charged with gas and the means for actuating said piston and cylinder means includes, movable means initially limiting the communication of the gas with said piston.

3. The apparatus of claim 1 wherein the slip means includes drag blocks for engaging the interior of the conduit for preventing expansion of said slip means on downward movement of the tool through the conduit.

4. The apparatus of claim 1 wherein the body is releasably connected to one of the piston and cylinder means and the slip means includes a wedge member releasably locked to the other of the piston and cylinder means for initially locking said piston and cylinder means together.

5. A tool for setting in or pulling from a conduit a downhole tool having a pair of actuating shoulders which are moved relative to each other comprising, a tubular body, slip means telescopically positioned on the exterior of the body for engaging the interior of the conduit, drag block means connected to the slip means for engaging the interior of the conduit for preventing expansion of said slip means on downward movement of the tool through the conduit, first and second shoulder members for engaging said actuating shoulders, coacting piston and cylinder means, one of said piston and cylinder means is connected to the first shoulder member and the second of said piston and cylinder means is connected to the second shoulder member, said cylinder means being charged with a gas, a wedge member positioned for expanding said slip means and connected to one of the piston and cylinder means and releasably connected to the other of the piston and cylinder means for initially locking said piston and cylinder means together, and a connection between the body and one of the piston and cylinder means whereby upward movement of the body will set the slip means and release the piston and cylinder means from each other allowing the piston and cylinder means to move the first and second shoulder members relative to each other.

6. The apparatus of claim 5 includes, movable means initially limiting the communication of the gas with said piston.

* * * * *